United States Patent [19]

Blanchard

[11] 4,360,930

[45] Nov. 30, 1982

[54] FLEXIBLE-HEADBAND ATTACHMENT FOR A FLASHLIGHT

[76] Inventor: Floyd W. Blanchard, 2231 Earl St., Los Angeles, Calif. 90039

[21] Appl. No.: 162,190

[22] Filed: Jun. 23, 1980

[51] Int. Cl.[3] ..... A42B 1/24

[52] U.S. Cl. ..... 2/209.2; 362/105

[58] Field of Search ..... 2/209.2, 185 R, 199, 2/DIG. 11; 362/105

[56] References Cited

U.S. PATENT DOCUMENTS 1,530,402 3/1925 Parker ..... 362/105
2,263,577 11/1941 Griner ..... 362/105
3,069,538 12/1962 Hobson ..... 362/105

FOREIGN PATENT DOCUMENTS 979109 12/1950 France ..... 362/105
830397 3/1960 United Kingdom ..... 362/105

*Primary Examiner*—Peter P. Nerbun
*Attorney, Agent, or Firm*—Max E. Shirk

[57] ABSTRACT

Flexible headband is connected to one side of a flashlight in a manner such that the headband may be wrapped around the body of the flashlight with the terminal wrap being secured to the flashlight when the headband is not in use.

17 Claims, 9 Drawing Figures

FLEXIBLE-HEADBAND ATTACHMENT FOR A FLASHLIGHT

BACKGROUND OF THE INVENTION

The background of the invention will be set forth in two parts.

1. Field of the Invention

The present invention pertains generally to headbands for flashlights and more particularly to a universal attachment device for attaching a flexible band to a flashlight.

2. Description of the Prior Art

The following prior art is presently known to applicant:

Parker U.S. Pat. No. 1,530,402
Pratt U.S. Pat. No. 1,904,902
Griner U.S. Pat. No. 2,263,577
Ostli U.S. Pat. No. 2,421,643
Mays U.S. Pat. No. 2,765,398
Hobson U.S. Pat. No. 3,069,538
Kidd U.S. Pat. No. 3,069,539

Parker discloses a headgear for holding flashlights The headgear includes a headband at the front of which is mounted U-shaped metal clip having its bight portion affixed to the headband with its spaced-apart legs extending forwardly from the headband. A U-shaped bail has the ends of its legs pivotably connected to the ends of the legs of the clip and is adapted to cradle a flashlight in a manner such that the flashlight is swingably mounted in a manner such that it projects forwardly from the front of the head of a wearer of the headgear.

Pratt discloses a headband which swingably supports the lens, reflector, and bulb assembly of a flashlight which is connected to a flashlight by a long wire. The headband positions the lens assembly on the forehead of a wearer of the headband.

Hobson discloses an arrangement similar to that disclosed in Pratt except that the lens assembly is affixed to the bill of a baseball cap.

The mounting devices of Parker, Pratt and Hobson may be referred to as "front-mounting devices." Such devices have the disadvantage that the typical flashlight, which has its long axis in the direction of the light beam axis, must project forwardly from the forehead or hat of a wearer of the device the full distance of the length of the flashlight. This requires a cumbersome mechanism and probably is practical only for small flashlights or a special arrangement wherein the head of the flashlight may be worn on the head of a user with the body portion of the flashlight being carried in the user's pocket or the like.

Ostli, Mays and Kidd disclose various arrangements for mounting a flashlight on the top of headgear worn by a user. These will be referred to as "top-mounting devices."

While generally satisfactory, top-mounting devices do have certain disadvantages. One disadvantage resides in the fact that devices for mounting a flashlight on the rounded head surface of a user results in an inherently unstable structure. Another disadvantage resides in the fact that these devices usually require cumbersome and restricting chin straps. Yet another disadvantage resides in the fact that vertical adjustment of the flashlight beam is restricted by the fact that the flashlight cannot be mounted more than a very limited distance above the head of the user.

Griner discloses a headband for a flashlight which overcomes some of the disadvantages enumerated above by mounting the flashlight on the side of the head of the user. Thus, although the Griner side-mounting device has certain advantages over the other prior art devices, it still suffers from the disadvantage that the flashlight to which the headband is attached must be of a particular construction in order to accommodate the headband.

Another disadvantage with the Griner device resides in the fact that vertical adjustment of the flashlight beam is limited to the amount the headband may be canted on the head of a user.

SUMMARY OF THE INVENTION

In view of the foregoing disadvantages of prior art devices for mounting a flashlight on the head of a user, it is the primary object of the present invention to provide a new and useful flexible-headband attachment for a flashlight not subject to the disadvantages enumerated above and having an improved apparatus for connecting a headband to a flashlight.

Applicant has considered the problem of wearing the typical elongated flashlight on the head of a user with a minimum of gear holding the flashlight in position. Applicant first considered the shape of the human skull; viewed from above, it is oval in shape with curved ends front and back and relatively straight sides; viewed from the front or side the top of the skull is rounded; thus the only portion of the skull where an elongated flashlight may rest naturally is along the side of the head; since the sides of the head are aligned more or less with the viewing area of the eyes, the flashlight may naturally point in the general area of vision of the user with a minimum of mechanical aides.

Since the elongated flashlight lies naturally against the relatively straight side of the head, a simple band around the head horizontally will secure the flashlight in position. Maximum stabilization to prevent undue shaking and vibration of the flashlight when the head is moved may be obtained by spacing the connections between the band and the flashlight a sufficient distance apart, but not such a distance that the connecting points extend beyond the straight side-portion of the head so as to interfere with the conformity of the head to the band.

In the present invention, these connections are made by an apparatus connected to the flashlight in a manner such that the flashlight becomes a portion of the band encircling the head. A pivot connection between the apparatus and the flashlight may be used, if desired, so that the flashlight may be adjusted in the vertical plane to suit the vision of the user.

According to the present invention, an apparatus is provided for connecting a headband to a flashlight. The apparatus includes a first member or plate having first and second ends; a suitable connecting device for connecting the first member to the flashlight body; a second connecting device for pivotably coupling one end of the headband to one end of the first member; and a third connecting device for coupling the other end of the headband to the flashlight.

In a first embodiment of the present invention, the third connecting device comprises a hook releasably connecting said other end of the headband to the other end of the first member so that the other end of the headband may be disconnected from the other end of the first member whereupon the headband may be pivoted at said one end until the major axis of the headband lies normal to the major axis of the flashlight body; the headband may then be wrapped around the flashlight body in a plurality of layers and secured by engaging the hook in one of the layers.

In a second embodiment of the present invention, the second and third connecting devices are apertures provided in the ends of the first member so that the ends of the headband may be affixed to the apertured ends of the first member in a manner such that the apertured ends function as pivots for the ends of the headband. With the arrangement, the headband may be arranged with its major axis lying along the major axis of the flashlight body when the headband and the flashlight are worn on the head of a user of the flashlight and then the headband may be arranged with its major axis lying normal to the major axis of the flashlight body when the headband is to be wound about the flashlight body for storing the headband on the flashlight body.

In a third embodiment of the present invention. The apertured first member in the second embodiment is provided with an elongated slot connecting the apertures together so that the ends of the headband may be slid along the slot to positions immediately adjacent each other with the major axis of each half of the headband lying normal to the major axis of the flashlight body.

According to the first embodiment of the present invention, the first connecting device comprises a clamping device at least partially encompassing the flashlight body and a pin connecting the first member to the clamping device. In this embodiment, the clamping device is a metal C-clamp.

In a fourth embodiment of the present invention, the clamping device is a band which is clamped between two halves of the flashlight.

In the first four embodiments of the present invention, the first member is preferably pivotably connected to the flashlight so that its beam may be adjusted vertically. Additionally, the first member may include a projection about which the final wrap of the headband may be secured when the headband is wound about the flashlight body.

In a fifth embodiment of the present invention, the first member or plate has one end non-rotably secured to the flashlight on one side thereof and in slightly spaced relationship therewith. The plate is provided with an aperture intermediate its ends to which one end of the band is secured. The other end of the band is connected directly to the flashlight at a point spaced along the major axis of the flashlight from the first end of the plate and may be adapted to pivot with respect to the flashlight. The other end of the plate extends beyond the aperture and serves as a projection to which the final wrap of the headband may be secured when it is wound about the flashlight body.

The features of the present invention which are believed to be novel are set forth with particularity in the appended claims. The present invention, both as to its organization and manner of operation, together with further objects and advantages thereof, may best be understood by making reference to the following description taken in connection with the accompanying drawings in which like reference characters refer to like elements in the several views.

DESCRIPTION OF THE PREFERRED EMBODIMENTS

Figure 1:
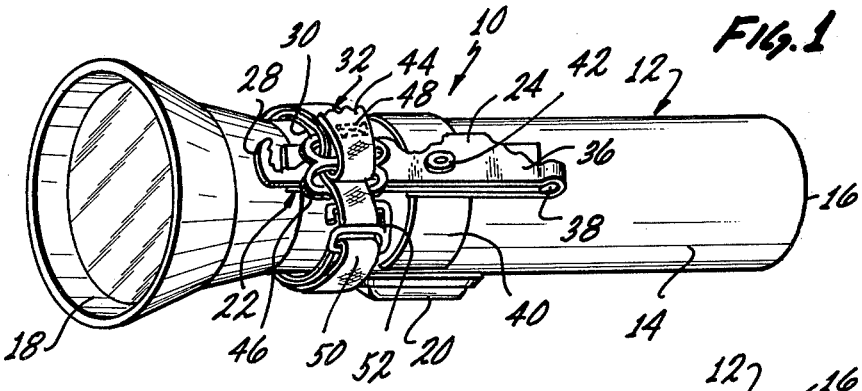
FIG. 1 is a perspective view of a flexible-headband attachment for a flashlight constituting a first embodiment of the present invention and showing a headband wrapped about a flashlight in stowed position.
Figure 2:
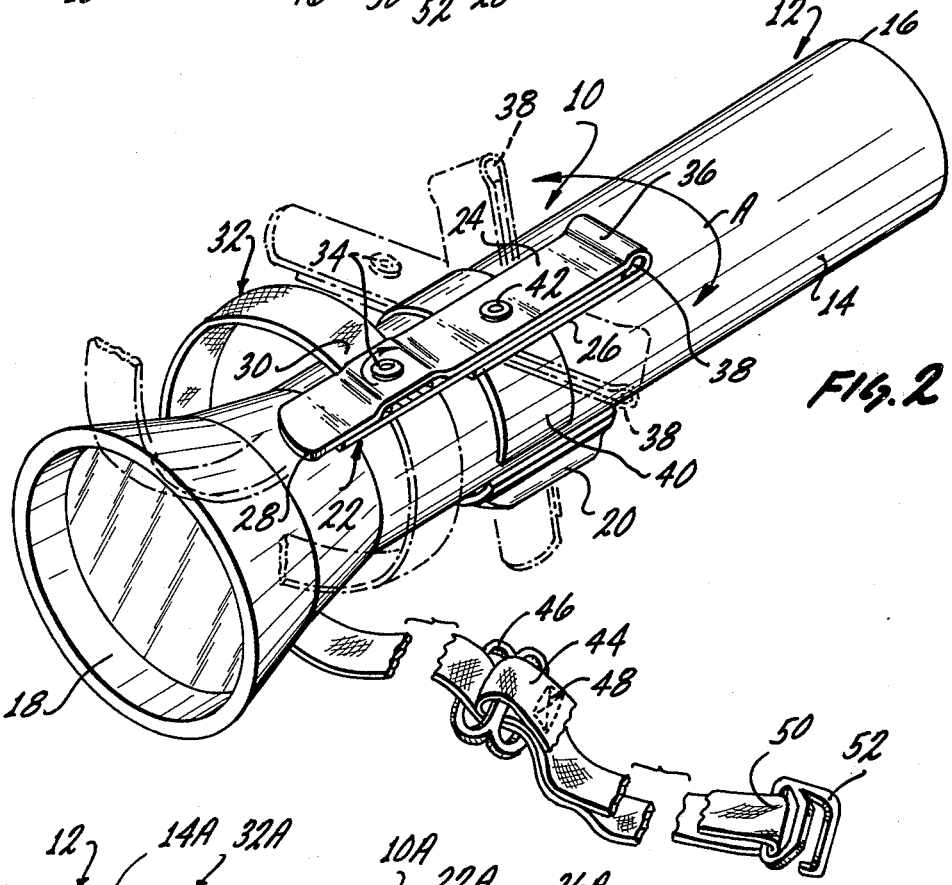
FIG. 2 is a perspective view of the device of FIG. 1 showing the headband and attachment in different positions.
Figure 3:
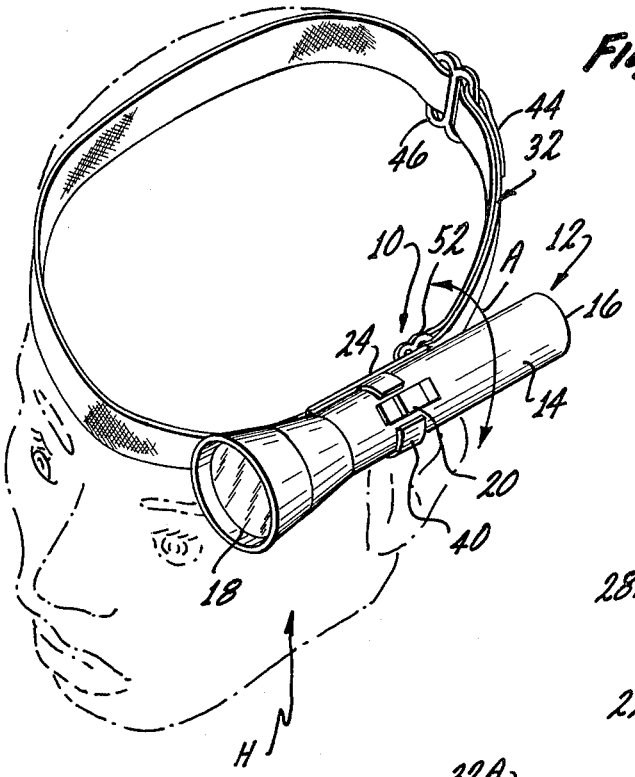
FIG. 3 is a perspective view of the embodiment of FIG. 1 showing the flashlight and headband in position of the head of a user.

Referring again to the drawings and more particularly to FIGS. 1 through 3, an apparatus for connecting a headband to a flashlight, generally designated 10, is shown in combination with a flashlight 12 having a body 14, a closed end 16, a lens end 18 and a switch 20.

Apparatus 10 includes an attachment member 22 including a rectangular plate 24, which may be made from a suitable metal or a fairly rigid polymeric material, and a plastic strip 26, which at least partially encompasses plate 24 and which may be made from a suitable polymeric material. Attachment member 22 also includes a first end 28 to which the first end 30 of a headband 32 may be pivotably connected by a suitable fastener or rivet 34, and a second end 36 having a bight 38 formed by slightly spacing the folded end of plastic strip 26 from the end of plate 24.

Attachment member 22 may be swingably connected to flashlight body 14 by a C-clamp 40 to which member 22 is affixed by a rivet 42 in a manner such that a frictional drag is imparted to attachment member 22 so that flashlight 12 may be maintained in different rotated positions.

Headband 32 may be made from a suitable elastomeric material and includes a second end 44 affixed to a suitable adjusting slide 46 by a row of stitches 48. Slide 46 is slidably mounted on headband 32 in a manner such that a loop 50 is formed therein adjacent end 44 for capturing a hook 52 and permitting the length of headband 32 to be adjusted. As best shown in FIG. 1, hook 52 is adapted to secure headband 32 in a stowed condition on flashlight 12 by positioning attachment member 22 on flashlight 12 with the major axis of attachment member 22 parallel to the major axis of flashlight body 14, positioning the major axis of headband 32 normal to the major axis of attachment member 22 and winding headband 32 about flashlight body 14 whereupon hook 52 may be engaged under a wrap layer of headband 32.

As best seen in FIG. 3, flashlight 12 may be positioned on the head H of a user by maintaining attachment member 22 in its FIG. 1 position, unwinding headband 32 from its stowed position, rotating end 30 of headband 32 on rivet 34 until the major axis of the headband is parallel to the major axis of member 22 and engaging hook 52 in bight 38 on end 36 of attachment 22. Flashlight 12 is preferably positioned along the side of head H and may be vertically adjusted along the user's line of vision, as indicated by the double-headed arrow A.

Figure 4:
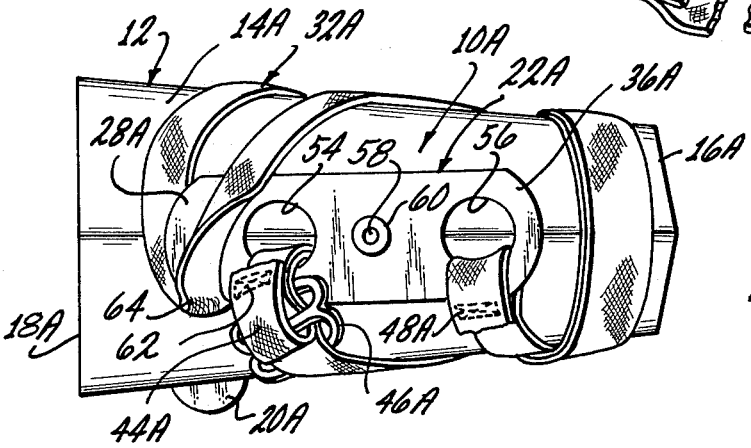
FIG. 4 is a perspective view of a second embodiment of the present invention showing a headband in stowed position on a flashlight.
Figure 5:
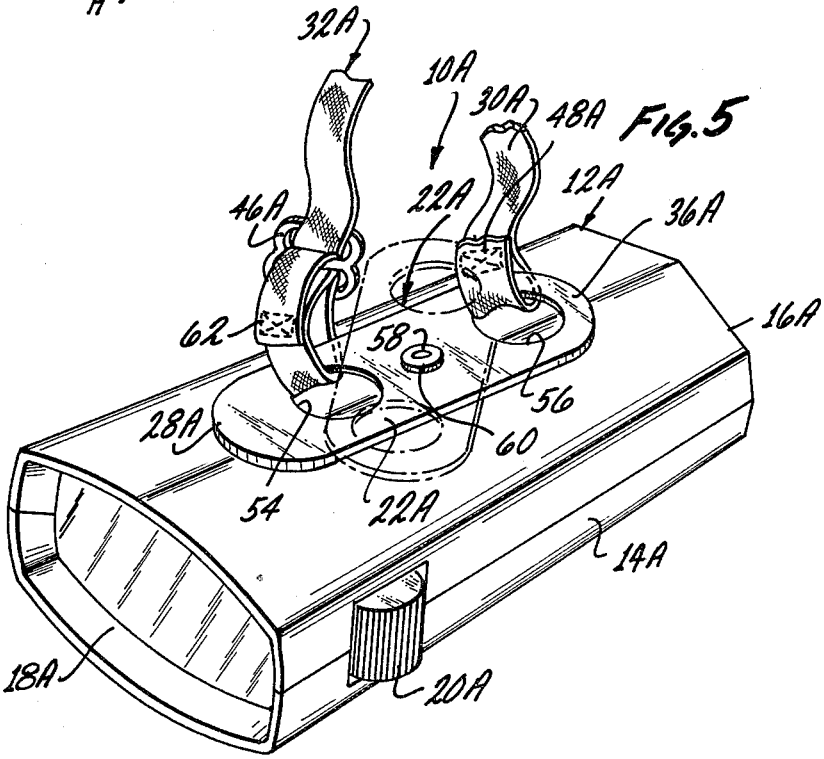
FIG. 5 is a perspective view of the embodiment of FIG. 4 showing the headband in an unwound condition.

Referring now to FIGS. 4 and 5, an apparatus for connecting a headband to a flashlight constituting a second embodiment of the present invention, generally designated 10A, is shown in combination with a flashlight 12A having a body 14A, a closed end 16A, a lens end 18A, and a switch 20A. Apparatus 10A includes an attachment member 22A having a first end 28A provided with an aperture 54 and a second end 36A provided with an aperture 56. Attachment member 22A may be made from a suitable metal or fairly rigid plastic material and is swingably connected to flashlight 12A by a rivet 58 and a washer 60 in a manner such that a frictional drag is imparted to attachment member 22A so that flashlight 12A may be retained in different rotated positions on the head of a user.

Apparatus 10A also includes headband 32A having a first end 30A passing through aperture 56 and secured to end 36A of attachment member 22A by suitable stitching 48A and a second end 44A passing through aperture 54 and connected to a slide 46A by stitches 62. Slide 46A is connected to headband 32A intermediate its ends for adjusting the length thereof.

It will be apparent to those skilled in the art that apertures 54, 56 permits ends 44A, 30A of headband 32A to pivot to different positions on ends 28A, 36A of attachment member 22A. When headband 32A is in position on the head of a user, ends 44A 30A will be pivoted to a position such that the major axis of headband 32A is substantialy parallel to the major axis of attachment member 22A. When headband 32A is not in use, ends 44A, 30A may be rotated to the positions shown in FIG. 4 where the major axis of headband 32A is normal to the attachment member 22A; this facilitates wrapping headband 32A about body 14A of flashlight 12A in a manner such that the loop 64 formed by folding headband 32A upon itself before it is wrapped about flashlight 12A may be engaged over end 28A of attachment member 22A thereby securing headband 32A in its stowed condition.

Figure 6:
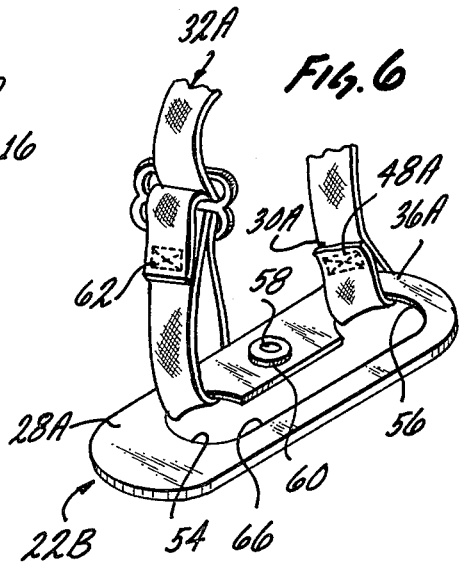
FIG. 6 is a perspective view of a modified form of the flexible-headband attachment as shown in FIGS. 4 and 5.

FIG. 6 shows an attachment member 22B which is identical to the attachment member 22A except that a slot 66 connects the apertures 54, 56 together so that ends 44A, 30A of headband 32A may be slid in slot 66 to positions closely adjacent each other before headband 32A is wrapped around flashlight 12A.

Figure 7:
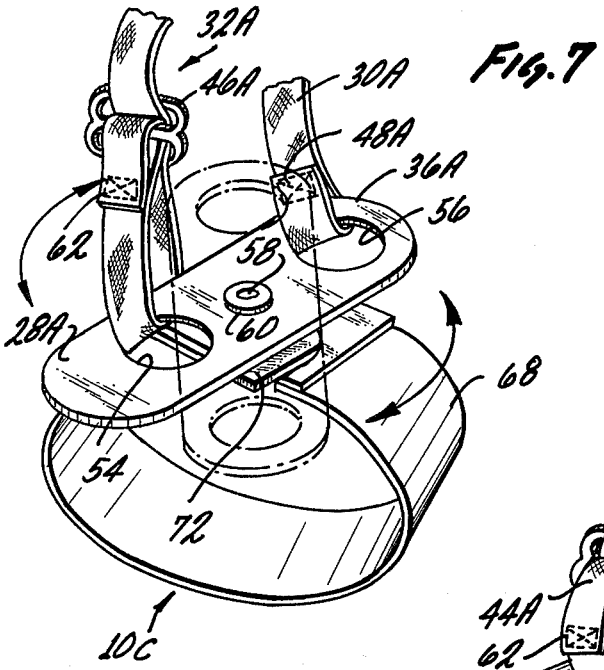
FIG. 7 is a perspective view of a flexible-headband attachment constituting a fourth embodiment of the present invention.
Figure 8:
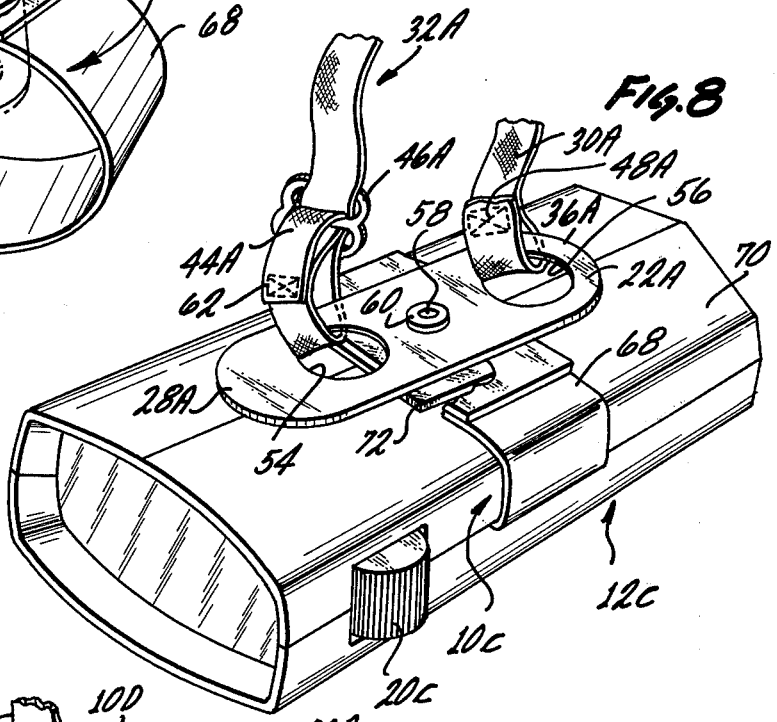
FIG. 8 is a perspective view of the attachment of FIG. 7 in combination with flashlight.

Referring now to FIGS. 7 and 8, an apparatus constituting a fourth embodiment of the present invention, generally designated 10C, is designed for use with a flashlight 12C of a type which may be separated into two parts along its major axis. Apparatus 10C includes a band 68 encompassing the upper half 70 of flashlight 12C. Attachment member 22A and headband 32A of the FIG. 5 embodiment may be affixed to band 68 by rivet 58 and washer 60. Band 68 may be made from a suitable polymeric material, and may be rigidified with a suitable spacer 72 made from a fairly rigid plastic material.

Figure 9:
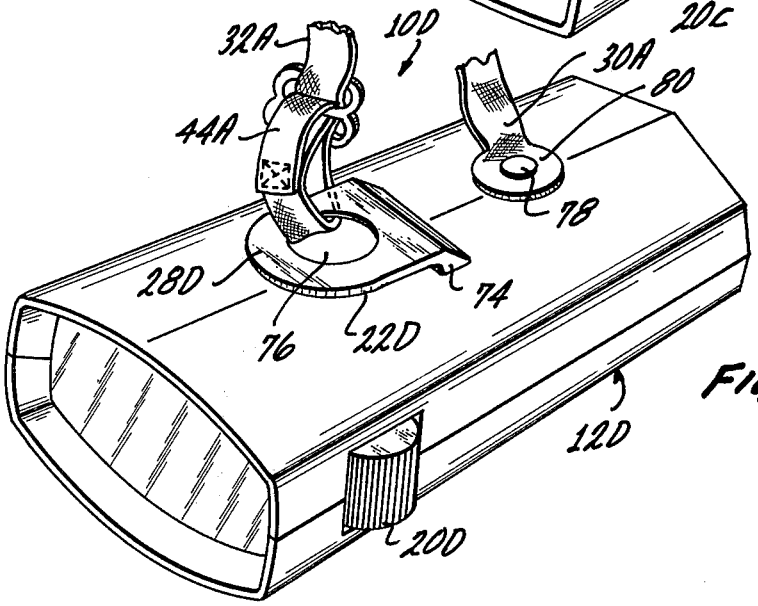
FIG. 9 is a perspective view of an attachment constituting a fifth embodiment of the present invention showing the attachment in combination with a flashlight.

Referring now to FIG. 9, an apparatus constituting a fifth embodiment of the present invention, generally designated 10D, may be used with flashlight 12A instead of apparatus 10A. Apparatus 10D includes an attachment member 22D which is somewhat L-shaped having a short leg 74, affixed to flashlight 12A by a suitable adhesive or the like. Attachment member 22D is provided with an aperture 76 receiving end 44A of headband 32A. End 30A of headband 32A is connected to flashlight 12A by a rivet 78 and a washer 80 in a manner such that end 30A may be pivoted on flashlight 12A with frictional resistance. Attachment member 22D includes a free end 28D constituting a projection for securing the terminal wrap of multiple wrap layers of headband 32A on flashlight 12A. It will be apparent to those skilled in the art that attachment member 22D may be molded integrally with the upper half of flashlight 12A from suitable polymeric materials.

While the particular embodiments of the headband connecting apparatus herein shown and described in detail are fully capable of attaining the objects and providing the advantages hereinbefore stated, it is to be understood that they are merely illustrative of the presently-preferred embodiments of the invention and that no limitations are intended to the details of construction or design herein shown other than as defined in the appended claims which form a part of this disclosure.

Whenever the term "means" is employed in these claims, this term is to be interpreted as defining the corresponding structure illustrated and described in this specification or the equivalent of the same.

What is claimed is:

1. Apparatus for connecting a headband having a minor axis, a major axis, a first end and a second end to a flashlight including a body having a major axis, a minor axis, a closed end and a lens end and a switch mounted on said body intermediate said ends, said apparatus comprising:

an attachment member having first and second ends;

first means for connecting said attachment member to said flashlight body;

second means for pivotably coupling one end of said headband to one end of said attachment member, whereby said one end of said headband may be rotated to selectively position the major axis of said headband parallel and normal to the major axis of said flashlight; and third means for coupling the other end of said headband to said attachment member.

2. An apparatus as stated in claim 1 wherein said third means comprises a hook releasably connecting said other end of said headband to the other end of said attachment member, whereby said other end of said headband may be disconnected from said other end of said attachment member so that said headband may be pivoted at said one end until said major axis of said headband lies normal to said major axis of said flashlight body whereupon said headband may be wrapped around said flashlight body in a plurality of layers and secured by engaging said hook in one of said layers.

3. An apparatus as stated in claim 1 wherein said second and third means each comprises an aperture provided in an associated end of said attachment member and fourth means affixing an associated end of said headband to said associated end of said attachment member in a manner such that said apertured end functions as a pivot for said associated end of said headband, whereby said headband may be arranged with its major axis lying along the major axis of said flashlight body when said headband and said flashlight are worn on the head of a user of said flashlight and whereby said headband may be arranged with its major axis lying normal to the major axis of said flashlight body when said headband is to be wound about said flashlight body for storing said headband on said flashlight body.

4. An apparatus as stated in claim 3 wherein said attachment member is provided with an elongated slot connecting said apertures together, whereby said ends of said headband may be slid along said slot to positions immediately adjacent each other with the major axis of each half of said headband lying normal to the major axis of said flashlight body.

5. An apparatus as stated in claim 1 wherein said first means comprises:

a clamping device at least partially encompassing said flashlight body; and a pin connecting said attachment member to said clamping device.

6. An apparatus as stated in claim 5 wherein said clamping device is a C-clamp.

7. An apparatus as stated in claim 5 wherein said flashlight body may be separated into two halves along its major axis and wherein said clamping device is a band encompassing one of said halves, whereby said band may be clamped between said halves by securing said halves together.

8. An apparatus as stated in claim 1 wherein said first means comprises a pivot pin pivotably connecting said attachment member directly to said flashlight body.

9. Apparatus for connecting a flexible headband having a minor axis, a major axis, a first end and a second end to a flashlight including a body having a major axis, a minor axis, a closed end and a lens end, and a switch mounted on said body intermediate said ends, said apparatus comprising:

an attachment member having first and second ends;

first and second means spaced apart on one side of said flashlight for pivotably connecting said headband first and second ends to said attachment member; and third means for securing the terminal wrap of multiple wrap layers of said headband, said wrap layers being wound around the body of said flashlight normal to said major axis of said flashlight.

10. An apparatus as stated in claim 9 wherein said first and second means permanently attach said headband first and second ends to said attachment member.

11. An apparatus as stated in claim 9 wherein said third means is a projection on one of said first and second means.

12. An apparatus as stated in claim 9 wherein said first and second means are located on said attachment member and wherein said attachment member is pivotably connected top said one side of said flashlight.

13. An apparatus as stated in claim 12 wherein said third means is located on said attachment member.

14. An apparatus as stated in claim 13 wherein said third means comprises a projection on said attachment member extending beyond one of said first and second means.

15. An apparatus as stated in claim 9 wherein at least one of said first and second means comprises an aperture engagable with an associated end of said headband.

16. An apparatus as stated in claim 9 wherein said attachment member is disconnectable from said flashlight.

17. An apparatus as stated in claim 9 wherein said first and second means constitute partial turn swivels connecting said headband first and second ends to said attachment member whereby said headband first and second ends are prevented from pivoting a full turn with resulting twisting of said headband.

* * * * *